US010704190B2

(12) United States Patent
Eun et al.

(10) Patent No.: US 10,704,190 B2
(45) Date of Patent: Jul. 7, 2020

(54) CLOTHING TREATMENT APPARATUS

(71) Applicant: LG ELECTRONICS INC., Seoul (KR)

(72) Inventors: Yousook Eun, Seoul (KR); Hyejin Choi, Seoul (KR); Jiyeon Min, Seoul (KR); Jungkyu Son, Seoul (KR)

(73) Assignee: LG Electronics Inc., Seoul (KR)

( * ) Notice: Subject to any disclaimer, the term of this patent is extended or adjusted under 35 U.S.C. 154(b) by 375 days.

(21) Appl. No.: 15/502,831

(22) PCT Filed: Aug. 11, 2015

(86) PCT No.: PCT/KR2015/008388
§ 371 (c)(1),
(2) Date: Feb. 9, 2017

(87) PCT Pub. No.: WO2016/024786
PCT Pub. Date: Feb. 18, 2016

(65) Prior Publication Data

US 2017/0233942 A1 Aug. 17, 2017

(30) Foreign Application Priority Data

Aug. 12, 2014 (KR) ..... 10-2014-0104403

(51) Int. Cl.
*D06F 73/02* (2006.01)
*D06F 58/14* (2006.01)
(Continued)

(52) U.S. Cl.
CPC ..... *D06F 73/02* (2013.01); *D06F 58/14* (2013.01); *D06F 59/02* (2013.01); *D06F 58/203* (2013.01)

(58) Field of Classification Search
CPC ..... D06F 35/00; D06F 58/14; D06F 58/20; D06F 58/203; D06F 59/02; D06F 73/00; D06F 73/02
See application file for complete search history.

(56) References Cited

U.S. PATENT DOCUMENTS 3,256,617 A * 6/1966 Konstandt ..... D06F 58/14 312/5
3,939,574 A 2/1976 Garot
(Continued)

FOREIGN PATENT DOCUMENTS

CN 1966832 A 5/2007
CN 203200558 A 9/2013
(Continued)

OTHER PUBLICATIONS

International Search Report in International Application No. PCT/KR2015/008388, dated Nov. 16, 2015, 9 pages (with English translation).
(Continued)

*Primary Examiner* — Jorge A Pereiro
*Assistant Examiner* — Logan P Jones
(74) *Attorney, Agent, or Firm* — Fish & Richardson, P.C.

(57) ABSTRACT

A clothing treatment apparatus is disclosed. The clothing treatment apparatus includes a first body detachably mounted on a wall, a second body rotatably or extendably provided at the first body to define a space for accommodating clothes, a rack provided at the first body or the second body, on which clothes are hung, and a hot air supply provided in the first body to supply hot air to clothes hung on the rack. The clothing treatment apparatus, mountable on a wall, enables efficient use of the clothing treatment space.

10 Claims, 10 Drawing Sheets

(51) Int. Cl.
*D06F 59/02* (2006.01)
*D06F 58/20* (2006.01)

(56) References Cited

U.S. PATENT DOCUMENTS

| | | | | | |
|---|---|---|---|---|---|
| 4,856,206 | A * | 8/1989 | Klein | D06F 57/12 | 34/619 |
| 5,070,628 | A * | 12/1991 | Zagar | B05C 11/06 | 34/644 |
| 2009/0200255 | A1* | 8/2009 | Leighton | D06F 57/12 | 211/119.18 |

FOREIGN PATENT DOCUMENTS

| | | | | | |
|---|---|---|---|---|---|
| CN | 203440684 | A | 2/2014 | | |
| EP | 0251898 | A | 1/1988 | | |
| EP | 0260394 | | 3/1988 | | |
| EP | 658646 | A1 | 6/1995 | | |
| FR | 1256028 | A * | 3/1961 | D06F 53/045 | |
| FR | 1465023 | A * | 1/1967 | D06F 58/14 | |
| FR | 1571470 | A * | 6/1969 | D06F 57/12 | |
| FR | 2054819 | A5 * | 5/1971 | D06F 58/14 | |
| FR | 2189560 | A1 * | 1/1974 | D06F 57/12 | |
| FR | 2693489 | A1 * | 1/1994 | D06F 58/14 | |
| GB | 951737 | A * | 3/1964 | D06F 58/14 | |
| GB | 1125280 | A1 | 8/1968 | | |
| KR | 10-2012-0074557 | | 7/2012 | | |
| KR | 10-2013-0026835 | | 3/2013 | | |
| KR | 10-2014-0016093 | | 2/2014 | | |
| KR | 10-2014-0023121 | | 2/2014 | | |
| KR | 2014023121 | A | 2/2014 | | |
| WO | WO2006059225 | A1 | 6/2006 | | |

OTHER PUBLICATIONS

Chinese Office Action in Chinese Application No. 201580043336.9, dated Jul. 19, 2018, 10 pages.
Extended European Search Report in European Application No. 15831339.5, dated Feb. 15, 2018, 7 pages.

* cited by examiner

[ Fig. 1]
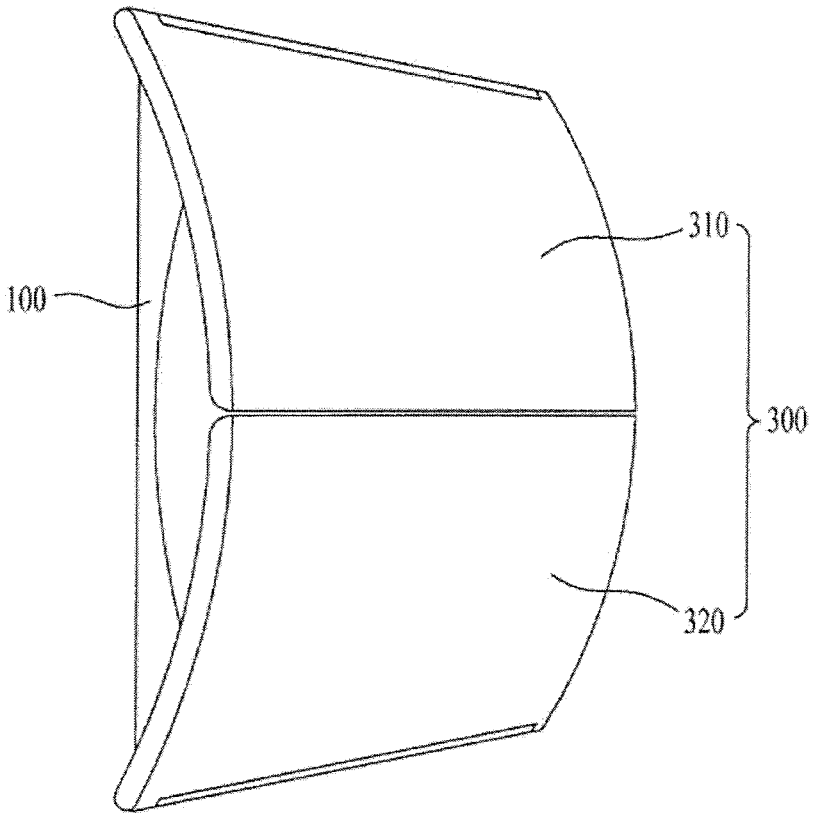

[ Fig. 2]
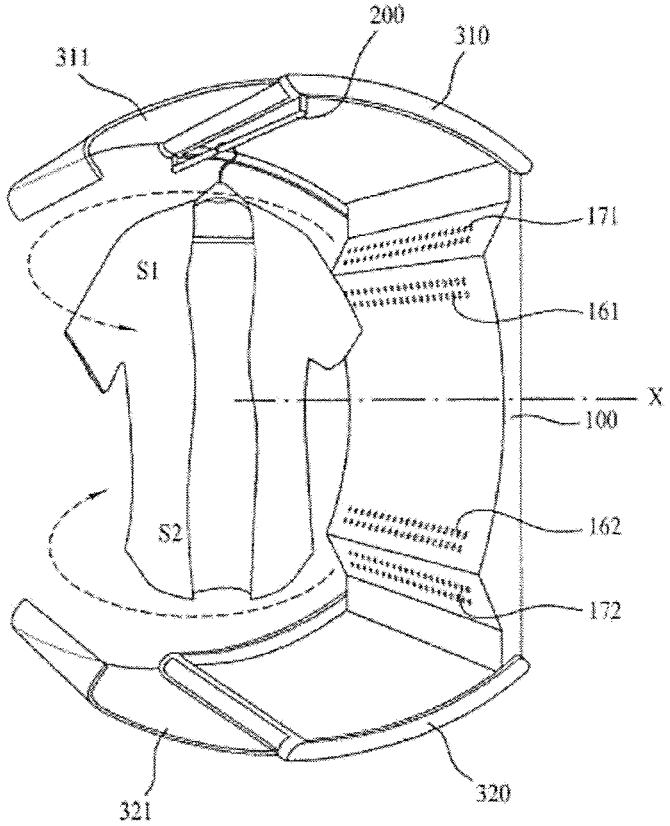

[ Fig. 3]
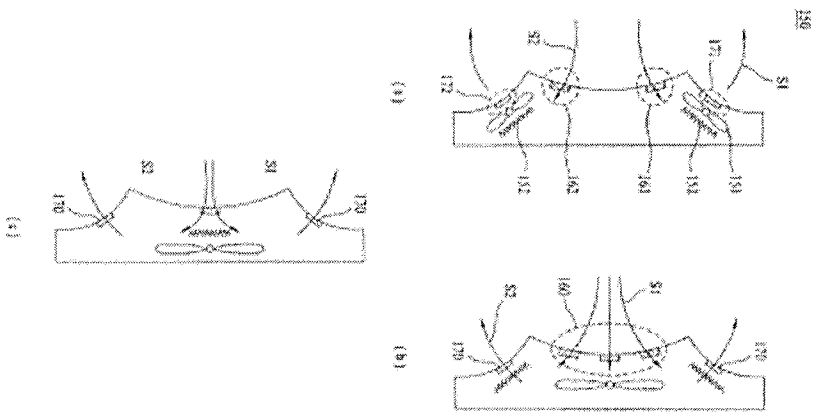

[ Fig. 4]
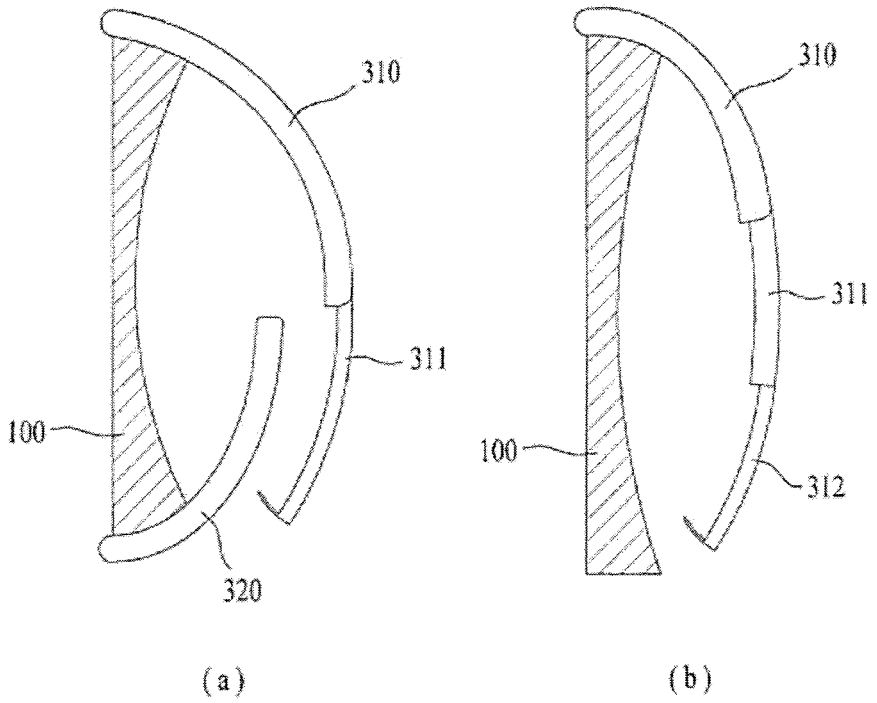

[ Fig. 5]
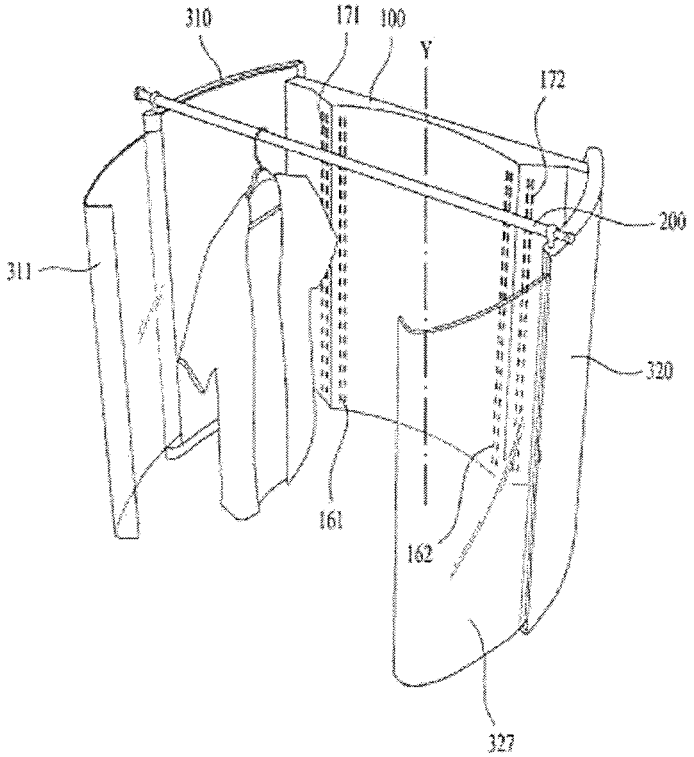

[ Fig. 6]
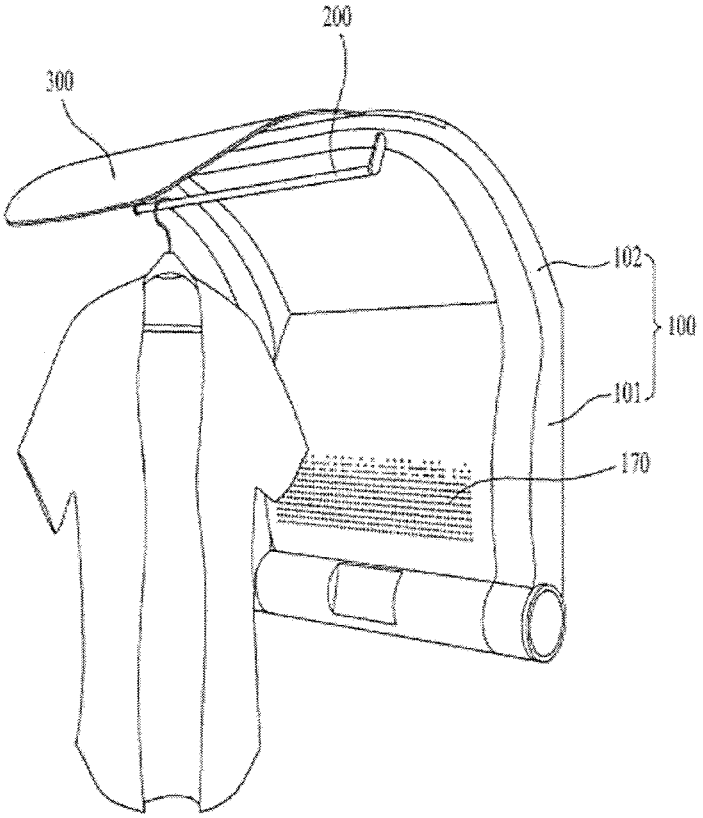

[ Fig. 7]
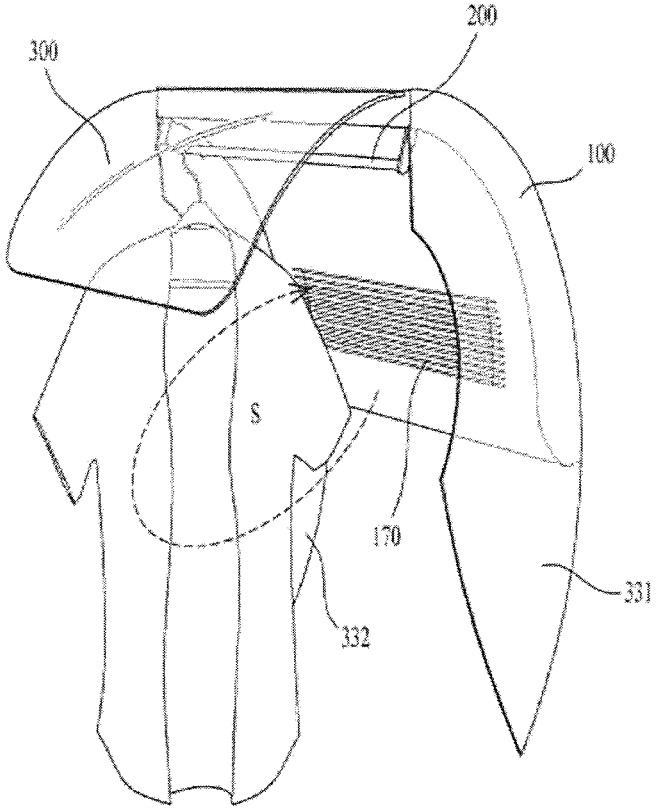

[ Fig. 8]
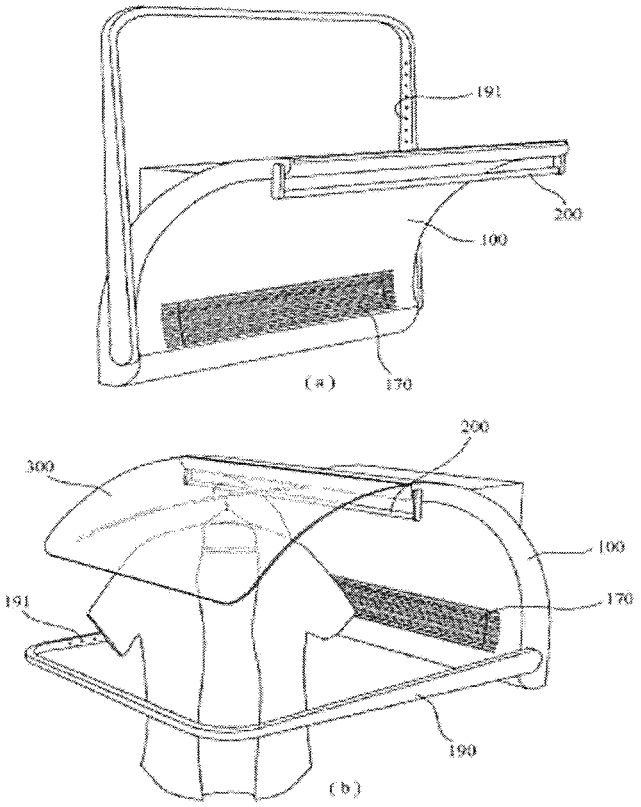

[ Fig. 9]
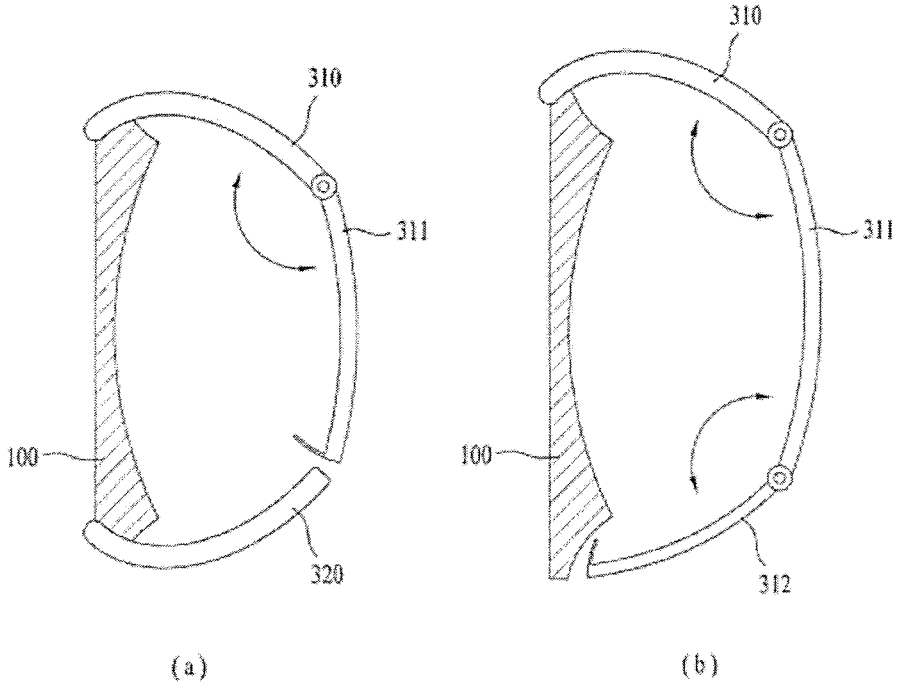

[ Fig. 10]
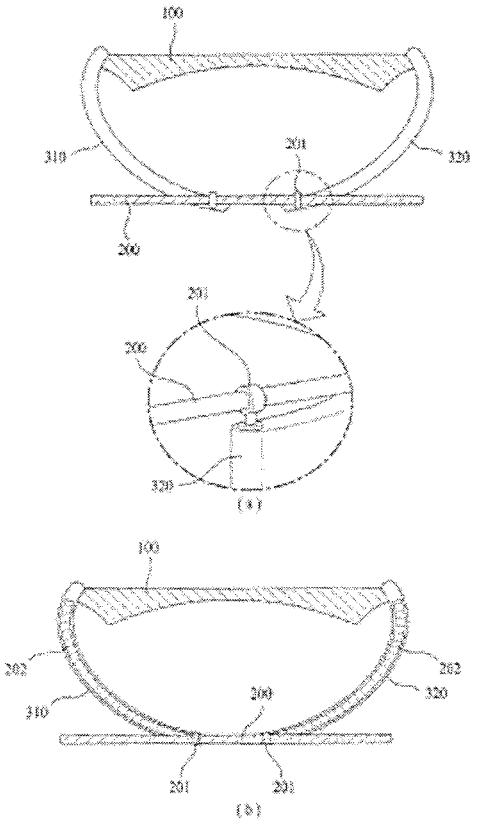

CLOTHING TREATMENT APPARATUS

CROSS REFERENCE TO RELATED APPLICATIONS

This application is a U.S. National Phase Application under 35 U.S.C. § 371 of International Application PCT/KR2015/008388, filed on Aug. 11, 2015, which claims the benefit of Korean Application No. 10-2014-0104403, filed on Aug. 12, 2014, the entire contents of which are hereby incorporated by reference in their entireties.

TECHNICAL FIELD

The present invention relates to a clothing treatment apparatus.

BACKGROUND ART

A clothing treatment apparatus typically includes a washer for washing clothes and a dryer for drying clothes that have been washed. In recent years, complex clothing treatment apparatuses, in which a washer and a dryer are combined with each other, are increasingly widely used.

Clothes, which have been subjected to washing and drying procedures, contain wrinkles generated by friction with a drum, provided in a clothing treatment apparatus, or the like. As a result, the clothes cannot maintain the normal shape, and have a wrinkled shape. Accordingly, a user has a difficulty in immediately wearing clothes that have been subjected to washing and drying procedures, and it is troublesome in that the clothes have to be additionally subjected to an ironing procedure or the like.

In addition, since common utility rooms, which are equipped with clothing treatment apparatuses, do not have a relatively wide space, there is a problem of installation of the clothing treatment apparatus in terms of the installation area.

DISCLOSURE OF INVENTION

Technical Problem

An object of the present invention devised to solve the problem lies on the provision of a clothing treatment apparatus capable of refreshing clothes by spraying air to the clothes.

Another object of the present invention devised to solve the problem lies on the provision of a clothing treatment apparatus, which is constructed to be detachably mounted on a wall so as to efficiently employ the space for installation of the apparatus.

Solution to Problem

The object of the present invention can be achieved by providing a clothing treatment apparatus including a first body detachably mounted on a wall, a second body extending from the first body in a direction away from the wall, a rack provided at the first body or the second body, on which clothes are hung, and a hot air supply provided in the first body to supply hot air to clothes hung on the rack, wherein the hot air supply includes an air outflow hole, an air inflow hole, a fan and a heater assembly.

The second body may be rotatable or extendable.

The second body may be integrally formed with the first body.

The second body may include first and second doors provided at respective opposite ends of the first body.

The first door may be rotatably provided at the upper portion of the first body, and the second door may be rotatably provided at the lower portion of the second body, wherein the first door may be rotatably coupled at a stationary end thereof to the upper portion of the first body, and the first door may include a first door extension provided at the free end thereof, wherein the second door may be rotatably coupled at a stationary end thereof to the lower portion of the first body, and the second door may include a second door extension provided at a free end thereof.

The first door extension and the second door extension may be retractable into the first door and the second door, respectively.

The first door extension and the second door extension may be rotatably coupled to the first door and the second door, respectively.

The air outflow hole may include a first air outflow hole and a second air outflow hole, and the air inflow hole may include a first air inflow hole and a second air inflow hole, wherein the first air outflow hole and the first air inflow hole may be positioned above a horizontal center axis of the first body, and the second air outflow hole and the second air inflow hole may be positioned below the horizontal center axis of the first body.

The first air outflow hole may be positioned above the first air inflow hole, and the second air outflow hole may be positioned below the second air inflow hole.

The first door may be rotatably provided at a first lateral side of the first body, and the second door may be rotatably provided at a second lateral side of the second body, wherein the first door may be rotatably coupled at a stationary end thereof to the first lateral side of the first body, and the first door may include a first door extension provided at the free end thereof, wherein the second door may be rotatably coupled at a stationary end thereof to the second lateral side of the first body, and the second door may include a second door extension provided at the free end thereof.

The first door extension and the second door extension may be retractable into the first door and the second door, respectively.

The first door extension and the second door extension may be rotatably coupled to the first door and the second door, respectively.

The air outflow hole may include a first air outflow hole and a second air outflow hole, wherein the first air outflow hole may be positioned at a first side of a vertical center axis of the first body, and the second air outflow hole may be positioned at a second side of the vertical center axis of the first body, and wherein the air inflow hole may be provided at a lower area of the first body.

The first body may include a first guide provided at a first lateral side thereof, and a second guide provided at a second lateral side thereof.

The clothing treatment apparatus may further include a hot air jet bar rotatably provided at the first body.

Advantageous Effects of Invention

As described above, the clothing treatment apparatus according to the present invention, which is constructed to be mountable on a wall, can supply hot air to clothes to dry the clothes.

Furthermore, the clothing treatment apparatus according to the present invention is detachably mounted on a wall, and thus the clothing treatment apparatus can enable efficient use of installation space.

BRIEF DESCRIPTION OF DRAWINGS

The accompanying drawings, which are included to provide a further understanding of the invention, illustrate embodiments of the invention and together with the description serve to explain the principle of the invention.

In the drawings:

FIG. 1 is a perspective view showing a clothing treatment apparatus according to the present invention;

FIG. 2 is a perspective view of the clothing treatment apparatus according to the present invention in which doors are opened;

FIG. 3 is a view showing embodiments of a hot air supply provided in a body;

FIG. 4 is a cross-sectional view showing other embodiments of the door of the clothing treatment apparatus shown in FIG. 1;

FIG. 5 is a perspective view showing another embodiment of the clothing treatment apparatus according to the present invention;

FIG. 6 is a perspective view showing still another embodiment of the clothing treatment apparatus according to the present invention;

FIG. 7 is a perspective view showing yet another embodiment of the clothing treatment apparatus according to the present invention;

FIG. 8 is a perspective view showing still yet another embodiment of the clothing treatment apparatus according to the present invention;

FIG. 9 is a cross-sectional view showing another embodiment of the second door of the clothing treatment apparatus according to the present invention; and FIG. 10 is a view showing the clothing treatment apparatus shown in FIG. 5, to which a hanger rack is securely provided.

BEST MODE FOR CARRYING OUT THE INVENTION

Hereinafter, a preferred embodiment of the present invention will be described with reference to the accompanying drawings.

The clothing treatment apparatus according to the present invention is differentiated from conventional cabinet-type clothing treatment apparatuses in terms of the space for accommodating clothes.

In other words, a conventional cabinet-type clothing treatment apparatus can be opened only at the front part thereof. More specifically, a conventional clothing treatment apparatus includes a cabinet having a space for accommodating clothes and a door for opening and closing the front part, and thus clothes are accommodated in a space that is closed on all sides.

Meanwhile, the clothing treatment apparatus according to the present invention includes a first body 100 and a second body 300 composed of a first door 310 and a second door 320, which partially cover the rear surface, upper surface, lower surface and front surface of the apparatus.

Hereinafter, a space in which hung clothes are dried and steam-treated will be referred to as a drying space.

FIG. 1 is a perspective view showing a subsidiary clothing treatment apparatus, which is detachably mounted on a wall, according to a preferred embodiment of the present invention.

Referring to FIG. 1, the clothing treatment apparatus according to the present invention includes the first body 100, and the second body 300 hingedly coupled to the first body 100.

According to the present invention, the second body 300 may be composed of the first door 310, which is hinged to be rotated in the upward direction of the first body 100, and the second door 320, which is hinged to be rotated in the downward direction of the first body 100.

As shown in FIG. 2, the first door 310 is configured to be rotated about the stationary end of the first door 100 in the upward direction of the first body 100, and the second door 320 is configured to be rotated about the stationary end of the second door 320 in the downward direction of the first body 100.

In other words, the first body 100 is mounted on a wall surface. At this point, when the first door 310 is rotated and opened upward and the second door 320 is rotated and opened downward, the drying space is defined therebetween, so as to allow clothes accommodated therein to be dried and steam-treated therein.

The drying space is configured between an upper surface defined by the first door 310, a lower surface defined by the second door 320, and a rear surface defined by the first body 100.

In order to ensure the provision of a wider drying space and improve drying efficiency, the apparatus may be further provided with extensions for shielding the drying space from the outside.

Specifically, the first door 310 is provided at the free end thereof with a first door extension 311, which is extendable in the direction of the free end of the first door 310, and the second door 320 is provided at the free end thereof with a second door extension 321, which is extendable in the direction of the free end of the second door 320.

In other words, the free end of the first door 310 is provided with the first door extension 311 and the free end of the second door 320 is provided with the second door extension 321 such that the drying space is increased or more reliably shielded from the outside so as to improved a drying efficiency.

In some cases, the first door extension 311 and the second door extension 321 may extend further than those shown in FIG. 2 so as to block the front surface of the drying space and thus improve drying and steam-treating efficiency.

As shown in FIG. 2, the first door 310, the first door extension 311, the second door 320 and the second door extension 321 may have predetermined curvatures. Accordingly, hot air discharged from the first body 100 may create circulation flows S1 and S2 circulating in the drying space, whereby it is possible to supply hot air continuously and efficiently to clothes accommodated in the drying space.

The first door 310 is further provided with a hanger rack 200 on which clothes are hung. The hanger rack 200 is preferably provided at the free end of the first door 310. At this point, since the free end of the first door 310 is positioned at the center of the drying space, it is possible for a user to efficiently employ the accommodation space.

Referring to 2, the first body 100 includes therein a hot air supply 150 (see FIG. 3), air outflow holes 170 and air inflow holes 160.

The hot air supply 150 includes fans 151 and heaters 152.

The fan 151, the heater 152, the air outflow holes 170 and the air inflow holes 160 of the hot air supply 150 may be provided at any position of the clothing treatment apparatus, and the installation positions thereof are not limited to the embodiment to be described hereinafter.

As shown in FIG. 2, first air outflow holes 171 and first air inflow holes 161 may be provided above the horizontal center line X of the first body 100, and second air outflow holes 172 and second air inflow holes 162 may be provided below the horizontal center line X of the first body 100.

Consequently, air, introduced through the first air inflow holes 161, is heated by the hot air supply (150) in the first body 100, and is then discharged through the first air outflow holes 171. Meanwhile, air, introduced through the second air inflow holes 162, is heated by the hot air supply 150 in the first body 100, and is then discharged through the second air outflow holes 172. As a result, two circulation flows may be created.

The circulation flows may be created as a first circulation flow S1 and a second circulation flow S2.

The first circulation flow S1 circulates in the upper part of the drying space to dry and steam-treat the upper part of the clothes, and the second circulation flow S2 circulates in the lower part of the drying space to dry and steam-treat the lower part of the clothes.

The first air outflow holes 171 are positioned above the first air inflow holes 161 to create the first circulation flow S1, and the second air outflow holes 172 are positioned below the second air inflow holes 162 to create the second circulation flow S2.

Alternatively, the first air outflow holes 171 and the second air outflow holes 172 may be provided at the lower surface of the first door 310 and the upper surface of the second door 320, respectively, so as to directly supply hot air to clothes accommodated in the drying space.

If the first air outflow holes 171 are positioned below the first air inflow holes 161 or the second air outflow holes 172 are positioned above the second air inflow holes 162, hot air discharged from the first air outflow holes 171 and the second air outflow holes 172 cannot circulate through the entire accommodation space, which is defined by the first door 310, the first door extension 311, the second door 320 and the second door extension 3217, thus deteriorating the drying efficiency.

Specifically, hot air discharged from the first air outflow holes 171 serves to dry the upper parts of clothes hanging on the hanger rack 200, and hot air discharged from the second air outflow holes 172 serves to dry the lower parts of the clothes hanging on the hanger lack 200.

Accordingly, the clothes accommodated in the clothing treatment apparatus according to the present invention can be evenly subjected to hot air at all portions of the clothes rather than at some of the portions thereof. Unlike conventional drying apparatuses, since the clothing treatment apparatus according to the present invention is constructed to supply hot air to clothes hanging on the hanger rack 200, it is possible to improve the effects of spreading the clothes by virtue of gravity and the effects of refreshing the clothes by virtue of reduction of interference with adjacent clothes.

FIG. 3 is view showing several embodiments of the hot air supply 100 provided in the first body 100.

FIG. 3(*a*) shows an embodiment which is constructed to create two circulation flows S1 and S2 in the above-described manner.

FIG. 3(*b*) shows an embodiment in which the air inflow holes 160 are provided in the center of the first body 100, unlike that shown in FIG. 3(*a*). Although three groups of air inflow holes 160 are illustrated in FIG. 3(*b*), the number of groups of air inflow holes 160 may be changed depending on the application conditions. The fan 151 is provided behind the air inflow holes 160 in order to create negative pressure in the first body 100 for the facilitation of air inflow.

The air outflow holes 170 are provided at upper and lower portions of the first body 100. The heaters 152 are provided behind the air outflow holes 170. At this point, since negative pressure is created in the first body 100 and the atmospheric pressure is present outside the air outflow holes 170, air, introduced through the air inflow holes 160 provided in the center of the first body 100, is heated by the heaters 152 provided behind the air outflow holes 170, and is then discharged through the air outflow holes 170 to the drying space due to the pressure difference.

FIG. 3(*c*) shows an embodiment in which the positions of the air inflow holes 160, the air outflow holes 170 and the fan 151 are the same as those of the embodiment shown in FIG. 3(*b*) but the heater 152 is provided between the air inflow holes 160 and the fan 151 so as to improve power efficiency.

This embodiment is intended to reduce the number of heaters 152 so as to improve efficiency of space utilization and reduce power consumption.

FIG. 4 is view showing various embodiments of the first door 310, the first door extension 311, the second door 320 and the second door extension 321 shown in FIGS. 1 and 2.

Referring to FIG. 4(*a*), the clothing treatment apparatus according to the present invention includes the first body 100 mounted at one side thereof on a wall surface, and the second body 300 rotatably coupled to the first body 100.

The second body 300 may include the first door 310, which is rotatable in the upward direction of the first body 100, and the second door 320, which is rotatable in the downward direction of the first body 100. The first door 310 has a length greater than that of the second door 320 such that the first door 310 overlaps the second door 320 when the first and second doors 310 and 320 are folded.

When the first and second doors 310 and 320 are rotated in the upward and downward directions, respectively, and the first door extension 311 is extendable from the first door 310, the drying space is defined between the components. At this point, since the first door 310 and the first door extension 311 more thoroughly shields the drying space from the outside, compared to the construction shown in FIG. 1, drying and steam-treating efficiencies for clothes are improved.

Furthermore, since the first door 310 and the first door extension 311 more thoroughly block the front side of the drying space, compared to the embodiment shown in FIG. 2, it is possible to provide a more efficient drying space.

Referring to FIG. 4(*b*), the clothing treatment apparatus according to the present invention includes the first body 100, mounted at one side thereof on a wall surface, and the second body 300, rotatably coupled to the first body 100.

The second body 300 may include the first door 310, which is rotatable in the upward direction of the first body 100, a first door main extension 311, which is extendable from the first door 310, and a first door subsidiary extension 312, which is extendable from the first door main extension 311.

The first door 310, the first door main extension 311 and the first door subsidiary extension 312 may provide a more efficient drying space.

Similarly to the embodiment shown in FIG. 4(*a*), the open front side of the drying space is more thoroughly blocked by the first door subsidiary extension 312, thus improving the drying and steam-treating efficiencies of clothes.

FIG. 9 is view showing further embodiments of the first door 310, the first door extension 311, the second door 320 and the first door subsidiary extension 312 shown in FIG. 4.

Referring to FIG. 9(*a*), the clothing treatment apparatus according to the present invention includes the first body 100, mounted at one side thereof on a wall surface, and the second body 300, rotatably coupled to the first body 100.

According to an embodiment of the present invention, the second body 300 may include the first door 310, which is rotatable in the upward direction of the first body 100, and the second door 320, which is rotatable in the downward direction of the first body 100. The first door 310 has a length greater than that of the second door 320 such that the first door 310 overlaps the second door 320 when the first and second doors 310 and 320 are folded.

The first door 310 and the second door 320 may be rotated in the upward and downward directions, respectively, and the first door extension 311 may be hingedly coupled to the first door 310.

Unlike the first door extension 311, shown in FIG. 4(*a*), which blocks only a portion of the front side of the drying space, the first door extension 311 shown in FIG. 9(*a*) may block the entire front side of the drying space. Accordingly, the drying space is more thoroughly blocked, thus improving the drying efficiency.

Referring to FIG. 9(*b*), the clothing treatment apparatus according to the present invention includes the first body 100 mounted at one side thereof on a wall surface, and the second body 300 rotatably coupled to the first body 100.

The second body 300 may include the first door 310, which is rotatable in the upward direction of the first body 100, a first door main extension 311, which is rotatably hinged to the first door 310, and a first door subsidiary extension 312, which is rotatably hinged to the first door main extension 311.

In some cases, the first door extension 311 may block only a portion of the front side of the drying space, or may block the entire front side of the drying space.

FIG. 5 is a view showing a clothing treatment apparatus according to another embodiment of the present invention, which is configured to define a drying space in a manner different from the clothing treatment apparatus shown in FIG. 2.

Referring to FIG. 5, the clothing treatment apparatus, configured to be detachably mounted on a wall, according to the present invention includes the first body 100 mounted at one side thereof on a wall surface, and the second body 310 and 320 rotatably coupled to the first body 100.

The second body 300 includes the first door 310 rotatably coupled to the left side of the first body 100, and the second door 320 rotatably coupled to the right side of the first body 310.

The first door 310 of the second body 300 of the clothing treatment apparatus is rotated to the left about the stationary end thereof to open the drying space, and the second door 320 is rotated to the right about the stationary end thereof to open the drying space.

In other words, the clothing treatment apparatus shown in FIG. 2 is configured to provide the drying space, which is closed at the rear side, the upper side and the lower side thereof, by rotating the first door 310 and the second door 320 in upward and downward directions, respectively, whereas the clothing treatment apparatus shown in FIG. 4 is configured to provide the drying space, which is closed at the left side, the right side and the rear side thereof, by rotating the first door 310 and the second door 320 to the left and right, respectively.

The first door 310 is provided with the first door extension 311. The first door extension 311 is preferably provided at the free end of the first door 310.

The second door 320 is provided with the second door extension 321, which is extendable from the second door 320. The second door extension 321 is preferably provided at the free end of the second door 320.

The left side of the clothing treatment apparatus is surrounded by the first door 310 and the first door extension 311, and the right side of the clothing treatment apparatus is surrounded by the second door 320 and the second door extension 321, thus defining an accommodation space therebetween. The accommodation space provides a space in which hot air discharged from the first body 100 circulates.

The hanger rack 200 may be detachable when the first door 310 and the second door 320 are opened. The opposite ends of the hanger rack 200 are preferably supported by the free end of the first door 310 and the free end of the second door 320.

Accordingly, the hanger rack 200 according to this embodiment is mounted on the clothing treatment apparatus only when the first door 310 and the second door 320 are opened to dry clothes, and is detached from the apparatus to reduce the volume of the apparatus when the apparatus is not used, thus being convenient to store.

In some cases, the hanger rack 200 may be fixedly provided to the clothing treatment apparatus.

The hot air supply 150, the air outflow holes 170 and the air inflow holes 160 may be provided in the first body 100 in any manner. The above structures shown in FIGS. 3(*a*), 3(*b*) and 3(*c*) may also be applied to this embodiment.

The first air outflow holes 171 may be provided at the left side of the vertical center axis Y of the first body 100, and the second air outflow holes 172 may be provided at the right side of the vertical center axis Y of the first body 100.

The air inflow holes 160 may be provided at the lower part of the first body 110. In other words, air introduced into the first body 100 through the air inflow holes 160 is heated by the hot air supply 150, and is then discharged through the first air outflow holes 171 and the second air outflow holes 172 formed in the first body 100.

The drawing shows an example of the position of the air inflow holes 160, and the air inflow holes 160 may be provided at any region of the clothing treatment apparatus according to the present invention.

The first air outflow holes 171 and the first air inflow holes 161 may be provided at a region of the left side of the vertical center axis of the first body 100, and the second air outflow holes 172 and the second air inflow holes 162 may be provided at a region of the right side of the vertical center axis of the first body 100.

Consequently, air, introduced through the first air inflow holes 161, is heated by the hot air supply (150) in the first body 100, and is then discharged through the first air outflow holes 171. Meanwhile, air, introduced through the second air inflow holes 162, is heated by the hot air supply 150 in the first body 100, and is then discharged through the second air outflow holes 172. As a result, two circulation flows may be created.

The first air outflow holes 171 are positioned at the left side of the first air inflow holes 161, and the second air outflow holes 172 are positioned at the right side of the second air inflow holes 162.

If the first air outflow holes 171 are positioned at the right side of the first air inflow holes 161 or the second air outflow holes 172 are positioned at the left side of the second air inflow holes 162, hot air discharged through the first air outflow holes 171 and the second air outflow holes 172 cannot circulate throughout the entire accommodation space defined by the first door 310, the first door extension 311, the second door 320 and the second door extension 321, thus deteriorating the drying efficiency.

FIG. 10 is a view showing an embodiment in which the hanger rack is securely provided at the clothing treatment apparatus shown in FIG. 5.

FIG. 10(*a*) is a view showing the clothing treatment apparatus at which the hanger rack is securely provided.

The first door 310 and the second door 320 may be provided at the upper edges thereof with respective support holders 201, each of which has a through hole through which the hanger rack 200 extends.

The hanger rack 200 may extend through the support holders 201, and may slide in the support holders 201.

Accordingly, when the first door 310 and the second door 320 are opened by a user, the support holders 210, securely provided at the first and second doors 310 and 320, move concurrently, and the hanger rack 200 thus slides in the support holders 201. As a result, the hanger rack 200 is securely held on the clothing treatment apparatus, as shown in FIG. 5.

FIG. 10(*b*) is a view showing another embodiment in which the hanger rack is securely provided at the clothing treatment apparatus.

Referring to FIG. 10(*b*), the first door 310 and the second door 320 may be provided at the upper ends thereof with rails 202 so as to allow the support holders 201 to slide along the rails 202.

In other words, the support holders 201 are slidably provided on the rails 202, and the hanger rack 200 may slidably move through the two support holders 201.

When a user opens the first door 310 and the second door 320 in order to use the clothing treatment apparatus, the support holders 201 slide along the rails 202, and the hanger rack 200 also slides through the support holders 201. As a result, the hanger rack 200 is securely held on the clothing treatment apparatus, as shown in FIG. 5.

The support holders 201 and the rails 202 are merely illustrated by way of example, and they may be constructed in different manners. The scope of the present invention is not limited to the construction shown in the drawings.

The clothing treatment apparatus shown in FIG. 6 includes a first body 100 mounted at one side thereof on a wall surface, and a second body 300, which is extendable from the first body 100.

The first body 100 includes a vertical part 101, configured to be parallel to a wall surface, and a bent part 102, projecting away from the wall surface. The second body 300 is extendably provided in the free end of the first body 100.

In other words, the vertical part 101 and the bent part 102 of the first body 100 and the second body 300 define the rear surface and the upper surface of the drying space.

The hanger rack 200 may be provided on the bent part 102.

When the drying and steam-treating functions are not used, the second body 300 may be retracted into the bent part 102 for its storage.

Since the hanger rack 200 is preferably provided at the free end of the bent part 102, the clothing treatment apparatus may accommodate clothes even when the drying and steam-treating functions are not used. Therefore, a user can employ the accommodation space more efficiently.

The air outflow holes 170 may be provided at the lower part of the first body 100. Therefore, hot air, discharged through the air outflow holes 170, rises, thus improving the heat efficiency and the drying efficiency of clothes.

FIG. 7 is a view showing a clothing treatment apparatus, which includes guides provided at both sides of a first body 100 so as to improve the drying efficiency of the embodiment shown in FIG. 6.

Referring to FIG. 7, the clothing treatment apparatus shown in FIG. 6 includes a first guide 331 provided at the right side thereof and a second guide 332 provided at the left side thereof.

In other words, the clothing treatment apparatus shown in FIG. 7 may include the first guide 331 and the second guide 332, in addition to the clothing treatment apparatus shown in FIG. 6. Accordingly, since all sides of the drying space are closed except for the front and lower sides, it is possible to improve the drying and steam-treating efficiencies.

The guides 331 and 332 are merely illustrated by way of example, and may be embodied to have various structures.

FIG. 8(*a*) is a perspective view showing a clothing treatment apparatus, which includes a hot air jetting bar 190, in addition to the clothing treatment apparatus shown in FIG. 6.

The hot air jetting bar 190 is rotatably coupled to the first body 100 to surround clothes accommodated in the drying space.

FIG. 8 illustrates an embodiment in which the hot air jetting bar 190 is provided at the lower end of the first body 100.

In some cases, the hot air jetting bar 190 may be provided at other positions, and the scope of the present invention is not limited to the embodiment.

The hot air jetting bar 190 includes jet nozzles 191 formed at the inner surface thereof to supply hot air to clothes accommodated in the drying space.

Unlike the clothing treatment apparatus shown in FIG. 2, in which clothes are dried by the circulation flows S1 and S2 created by hot air discharged through the air outflow holes 170 formed in the first body 100, the clothing treatment apparatus shown in FIG. 8 may implement the drying procedure using hot air directly jetted from the jet nozzles 191 provided on the inner surface of the hot air jetting bar 190 as well as hot air discharged through the air outflow holes 170 formed in the first body 100. So-called four-way drying is possible.

In this case, the air inflow holes (not shown) may be provided in the lateral side surfaces of the first body 100. It will be understood that the air inflow holes may be provided at any region of the clothing treatment apparatus.

FIG. 8(*b*) shows the clothing treatment apparatus in which the hot air jet bar 190 is lowered and the second body 300 is extended from the first body 100.

At normal times, the clothing treatment apparatus according to the present invention may minimize the drying space in such a manner as to rotate the hot air jet bar 190 upward and to retract the second body 300 into the first body 100. Upon carrying out the drying operation, the hot air jet bar 190 is lowered and the second body 300 is extended from the first body 100 so as to provide the accommodation space for clothes.

The second body 300 may be provided therein with an air discharge pipe 173, and may be provided at the free end thereof with the air outflow holes 170, through which hot air flowing through the air discharge pipe 173 is discharged.

The second body 300 including the air discharge pipe 172 therein may be applied to any of the embodiments shown in FIGS. 1 to 8

More specifically, since the clothing treatment apparatus according to the present invention includes the air discharge pipe 173 provided in the second body 300 and the air outflow holes 170 formed in the free end of the second body 300, it is possible to discharge hot air from all of the first body 100, the hot air jet bar 190, the second body 300 and the air outflow holes 170. Therefore, refreshing of clothes may be efficiently implemented.

It will be understood by those skilled in the art that the foregoing description is preferred embodiments of the present invention and that various changes and modifications may be made in the invention without departing from the spirit and scope thereof. For example, although the air discharge pipe 173 is described as being provided in the second body 300 in the above embodiments, the air discharge pipe 173 may also be provided in the first body 100 without limitation thereto.

MODE FOR THE INVENTION

Various embodiments have been described in the best mode for carrying out the invention.

INDUSTRIAL APPLICABILITY

The present invention provides the clothing treatment apparatus according to the present invention, which is constructed to be mountable on a wall and can supply hot air to clothes to dry the clothes.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

The invention claimed is:

1. A clothing treatment apparatus comprising:

a first body detachably mounted on a wall;

a second body extending from the first body in a direction away from the wall;

a rack provided at the first body or the second body, on which clothes are able to be hung; and a hot air supply provided inside the first body to supply hot air to clothes hung on the rack, wherein the hot air supply includes:

an air outflow hole provided to exhaust the hot air from the first body, an air inflow hole provided to suck the exhausted hot air into the first body, a fan provided inside the first body, and a heater assembly provided inside the first body to generate the hot air that refreshes the clothes, wherein the air outflow hole and the air inflow hole are both located on a same surface of the first body, facing a direction in which the clothes are hung on the rack, and wherein the air outflow hole and the air inflow hole are spaced apart from each other to circulate the hot air;

wherein the air outflow hole includes a first air outflow hole and a second air outflow hole, and the air inflow hole includes a first air inflow hole and a second air inflow hole, and wherein the first air outflow hole and the first air inflow hole are positioned above a horizontal center axis of the first body, and the second air outflow hole and the second air inflow hole are positioned below the horizontal center axis of the first body.

2. The clothing treatment apparatus according to claim 1, wherein the second body is rotatable or extendable.

3. The clothing treatment apparatus according to claim 1, wherein the second body is integrally formed with the first body.

4. The clothing treatment apparatus according to claim 2, wherein the second body includes first and second doors provided at respective opposite ends of the first body.

5. The clothing treatment apparatus according to claim 4, wherein the first door is rotatably provided at an upper portion of the first body, and the second door is rotatably provided at a lower portion of the second body, wherein the first door is rotatably coupled at a stationary end thereof to the upper portion of the first body, and the first door includes a first door extension provided at a free end thereof, wherein the second door is rotatably coupled at a stationary end thereof to the lower portion of the first body, and the second door includes a second door extension provided at a free end thereof.

6. The clothing treatment apparatus according to claim 5, wherein the first door extension and the second door extension are retractable into the first door and the second door, respectively.

7. The clothing treatment apparatus according to claim 5, wherein the first door extension and the second door extension are rotatably coupled to the first door and the second door, respectively.

8. The clothing treatment apparatus according to claim 1, wherein the first air outflow hole is positioned above the first air inflow hole, and the second air outflow hole is positioned below the second air inflow hole.

9. The clothing treatment apparatus according to claim 2, wherein the first body includes a first guide provided at a first lateral side thereof, and a second guide provided at a second lateral side thereof.

10. The clothing treatment apparatus according to claim 2, further comprising a hot air jet bar rotatably provided at the first body.

* * * * *